US006161717A

United States Patent [19]

Forrest et al.

[11] Patent Number: 6,161,717

[45] Date of Patent: Dec. 19, 2000

[54] END CLOSURE WITH REVERSE BEAD ON OPENING PANEL

[75] Inventors: Randy G. Forrest, Park Ridge, Ill.; Randy N. Caudill, Sidney, Ohio

[73] Assignee: American National Can Company, Chicago, Ill.

[21] Appl. No.: 09/244,867

[22] Filed: Feb. 5, 1999

[51] Int. Cl.[7] ..... B65D 17/34

[52] U.S. Cl. ..... 220/269; 413/16; 413/17

[58] Field of Search ..... 220/269; 413/8, 413/12, 15, 16, 17

[56] References Cited

U.S. PATENT DOCUMENTS

| | | | |
|---|---|---|---|
| Re. 31,702 | 10/1984 | Brown . | |
| D. 371,073 | 6/1996 | Taylor . | |
| 2,017,103 | 10/1935 | Newman . | |
| 3,478,918 | 11/1969 | Zundel . | |
| 3,886,881 | 6/1975 | Pearce et al. . | |
| 3,900,128 | 8/1975 | Brown . | |
| 3,941,277 | 3/1976 | McKinney et al. . | |
| 3,967,752 | 7/1976 | Cudzik . | |
| 4,030,631 | 6/1977 | Brown . | |
| 4,084,721 | 4/1978 | Perry . | |
| 4,132,328 | 1/1979 | Zundel . | |
| 4,149,479 | 4/1979 | Zundel . | |
| 4,184,607 | 1/1980 | Potts . | |
| 4,215,795 | 8/1980 | Elser . | |
| 4,363,419 | 12/1982 | Walz, Sr. . | |
| 4,511,299 | 4/1985 | Zysset . | |
| 4,524,879 | 6/1985 | Fundom et al. . | |
| 5,064,087 | 11/1991 | Koch . | |
| 5,375,729 | 12/1994 | Schubert . | |
| 5,385,254 | 1/1995 | Hannon . | |
| 5,456,378 | 10/1995 | DeMars . | |
| 5,692,636 | 12/1997 | Schubert | 220/271 |
| 5,715,964 | 2/1998 | Turner et al. | 220/269 |
| 5,860,553 | 1/1999 | Schubert | 220/271 |
| 5,875,911 | 3/1999 | McEldowney | 220/269 |

FOREIGN PATENT DOCUMENTS

| | | |
|---|---|---|
| 0 564 725 A1 | 10/1993 | European Pat. Off. . |
| 0 704 382 A2 | 4/1996 | European Pat. Off. . |
| 2 402 686 | 7/1974 | Germany . |
| WO 97/30902 | 8/1997 | WIPO . |

*Primary Examiner*—Stephen K. Cronin
*Attorney, Agent, or Firm*—Wallenstein & Wagner Ltd.

[57] ABSTRACT

The present invention provides an end closure for a container having a central panel wall with a displaceable opening panel defined by a frangible score and a non-frangible hinge segment. A tab is attached to the panel wall by a rivet, the tab having a nose extending over a first area of the opening panel, the remainder of the opening panel which is exposed from the tab defining the second area of the opening panel. A deboss bead resides in the opening panel, formed in the second area. The deboss bead being curvilinear in shape, formed as a narrow channel in the opening panel. The narrow channel preferably being formed as a U-shaped bead with a first wall and a generally opposed second wall, with the first and second wall being joined by an arcuate intermediate segment. The end closure further has a deboss panel residing in a plane below the remainder of the panel, the deboss bead extending below the plane of the deboss panel. The deboss bead is formed in the manufacturing operation of the score formation and is formed simultaneous with the formation of the score to draw up loose metal from the score incising of the metal.

18 Claims, 2 Drawing Sheets

END CLOSURE WITH REVERSE BEAD ON OPENING PANEL

DESCRIPTION

1. Technical Field of the Invention

The present invention relates to "ecology" end closures for two-piece beer and beverage metal containers, having a retained-tab secured by a rivet and an opening panel. More specifically, the present invention relates to improved characteristics for forming the opening panel with a deboss bead on the opening panel.

2. Background of the Invention

Typical end closures for beer and beverage containers have an opening panel and an attached leverage tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ends in which the tab remains attached to the end after the opening panel is opened. Because of numerous factors, including the need to use thin metal sheet for making the need and/or tab, the use of large-opening ends that require much force to open, and the need for improved opening characteristics of ends, there is a need in the industry for a can end with an opening panel that is stiff and has a low profile on the public side.

Prior art ecology ends sometimes include features that may partially provide stiffness to the opening panel, such as the prior art end feature of an emboss bead, a raised bead projecting upward from the public side of the end panel. However, these prior art ends have the disadvantage of having an opening panel that has an increased height and that is likely to exhibit doming or "crowning" when the end is seamed and sealed to a container filled with carbonated beverage.

Another type of prior-art ecology end has a depressed region of the opening panel, formed as a "down panel." This type of prior art end, with a down-panel on the opening panel, is very different from the formation of a bead on the opening panel. Rather, the down panel is formed on the opening panel as a depressed region, without the formation of a bead that appears U-shaped in cross-section. The down panel does not stiffen the opening panel, primarily because it does not adequately remove slack metal that is caused by the score formation. Therefore, there is a need in the industry for a stiffened opening panel that resolves the problems associated with the emboss beaded ends and the ends with a down panel on the opening panel.

Also, there is a need in the industry for ecology ends to have a low profile to improve stacking of the ends together for shipment and for use in seaming the ends to a container during the fill operation, i.e., when the container is filled with beer or other beverage and the end is seamed to the container. If there is too much "sponginess" of the ends stacked together, usually caused by poor nesting of the ends together due to the tab of an end being engaged with the underside of an end stacked on top, then the ends may exhibit conditions of poor stacking. Such sponginess can cause a number of undesirable effects, including: damage due to wear on the underside of the ends, loose stacking in packaging, increased length for a predetermined number of ends in a package, and faulty feeding of the ends during the fill and seaming operation of containers. Therefore, there is a need for an end design that will reduce or eliminate sponginess of ends and will permit improved stacking of ends together by reducing contact of the tab with the underside of a stacked end.

Further, there is a need in the industry for an ecology end that has a stiffened opening panel and that will allow relatively reduced doming when the container is subject to increased internal pressure, such as when the container is filled with carbonated beverage and/or when subjected to heat during pasteurization. Doming of the end panel, and especially doming of the opening panel, often may result in increased resistance of the opening panel from fracturing when the user lifts the tab. Therefore, there is a need for an ecology end with reduced doming of the opening panel and of the entire end panel.

As is understood by the disclosure herein, the present invention resolves the need in the industry for a can end having a stiff opening panel and a low profile for nesting of the tab and stacking of ends together. The deboss bead of the present invention stiffens the opening panel with greater effectiveness than the prior-art raised bead on the tear panel, while keeping the opening panel flat and less likely to dome from internal pressure of the container. Therefore, the present invention improves stacking and openability of ecology ends.

Also, there is need in the industry for an improved ecology end that is manufactured by a process that results in a bead formed in the opening panel at the same time as the scoring operation done to form the opening panel. Prior art methods of manufacturing ecology ends sometimes include raised beads being formed in the opening panel region. However, because of the tooling arrangement of the raised-bead tools, the bead could not be formed simultaneous with the score operation. Rather, the bead tools, when placed in the same manufacturing station as the score tools, would cause at least initial formation of the bead prior to the scoring operation. Therefore, there is a need for an improved ecology end and manufacturing method that permits the bead formation simultaneous with the formation of the score, thereby taking up slack metal due to score formation by the downward bead in the opening panel, to create a stiffer opening panel requiring reduced opening force.

SUMMARY OF THE INVENTION

It is an object of the present invention to provide an ecology end closure for a container, with a retained-tab and a central panel wall having a product side and a public side and a displaceable opening panel in the central panel wall defined by a frangible score and a non-frangible hinge segment. The end has a deboss bead formed in the opening panel, the deboss bead having a narrow channel formed downward of the product side. It is also an object of the present invention to provide an ecology end having a deboss bead on the opening panel wherein the deboss bead has a first circumferential wall generally opposed to a second circumferential wall, with the first and second wall being joined together by an arcuate intermediate segment.

It is further an object of the present invention to provide an ecology end closure for a container, with a retained-tab and an displaceable opening panel. The end has a central panel wall with an outer region generally defined along a first horizontal plane, and has a deboss panel surrounding the retained-tab and the opening panel and residing along a second horizontal plane positioned below the first horizontal plane. The end further has an inner deboss bead formed on the opening panel which forms a narrow channel extending downward from the second plane.

It is another object of the present invention to provide an ecology end that has an opening panel with a downward bead, wherein the downward bead is formed at the same time as the formation of the frangible score of the opening panel. In this arrangement during the manufacturing process, the scoring operation causes metal "movement" and results in slack metal in the opening panel, due to the score tool embedding into the metal. As the score operation is taking place, the downward bead is simultaneously formed by bending the metal in the opening panel around an upper bead die that is received into a lower bead anvil, thereby being adapted to take up loose metal during the score formation.

Other advantages and aspects of the invention will become apparent upon making reference to the specification, claims, and drawings to follow.

DETAILED DESCRIPTION OF THE DRAWINGS

Figure 1:
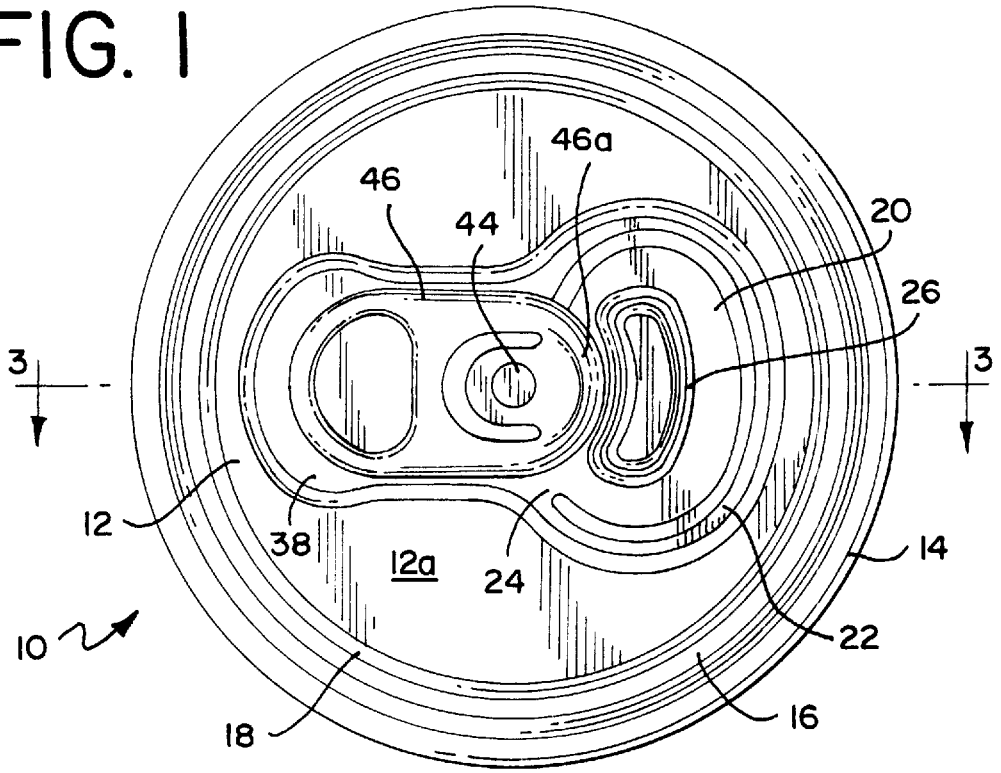
FIG. 1 is a plan view of the upper side an end closure of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Figures show a container end 10 according to the present invention, having improved opening characteristics with a structure adapted to provide a stiff opening panel 20, as described in detail below. One primary advantage of the present invention is to provide an opening panel 20 with an inner bead 26 that is a deboss bead formed as a depression in the public side 12*a* of the opening panel 20. This aspect of the present invention provides a stiffened opening panel 20 with reduced susceptibility to doming of the opening panel, thereby improving openability characteristics. The primary improvement of the opening characteristics of the end 10 is a reduction in the "push force" required to fracture and displace the opening panel 20 by the user lifting the tab 46 to push on the opening panel 20. Because the opening panel 20 exhibits little or no doming, and because the downward position of the deboss bead 26, the opening panel 20 is in optimal arrangement for being opened by the downward force of the nose 46*a* of the tab 46.

Further, the ecology end 10 made according to the present invention provides improved stacking characteristics for the ecology ends, primarily by the deboss bead 26 being a down-bead rather that an upward-extending bead and thereby reducing the tab height. The reduced tab height (i.e., the reduced elevation of the nose 46*a* of the tab 46 in relation with that of an end with an emboss bead on the opening panel) thereby reduces contact of the tab 46 with the product side 12*b* of an ecology end stacked on top of a like ecology end 10. The benefits of such reduced contact of the tab 46 with the product side 12*b* of an above-stacked like ecology end include: reduced "sponginess" of stacked ends, reduced wear of the coating on the product side 12*b* of the above-stacked end; and, reduced likelihood of residual amounts of lubrication on the tab 46 being transferred to the product side 12*b* of the above-stacked end.

Figure 2:
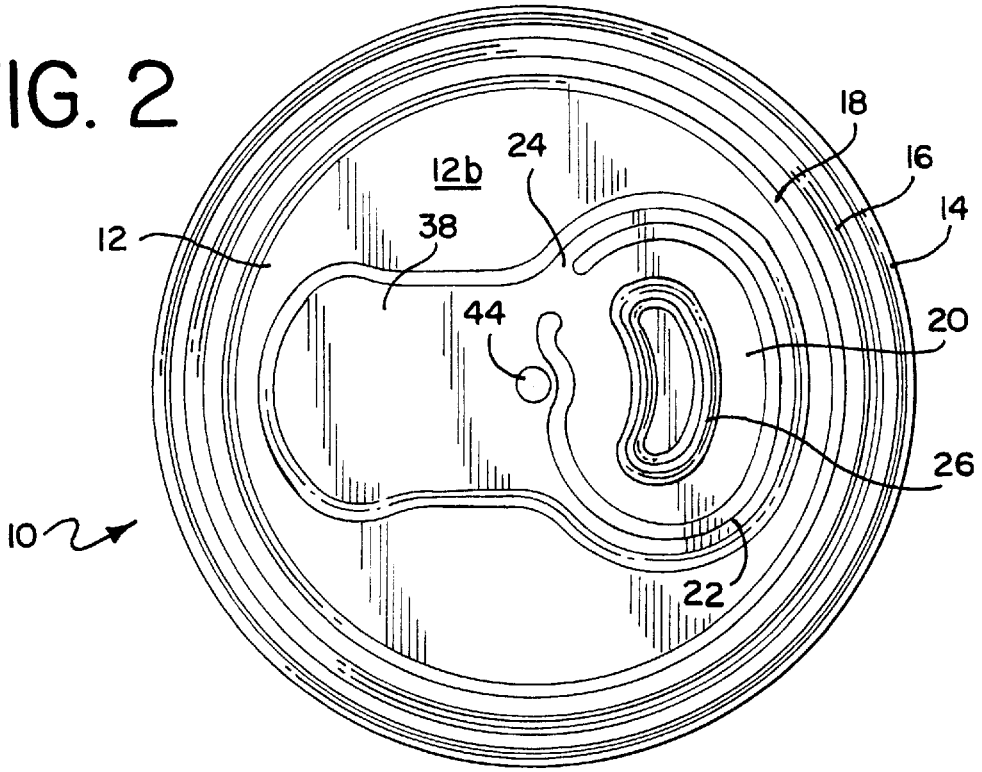
FIG. 2 is a plan view of the under side of the end of FIG. 1.
Figure 3:
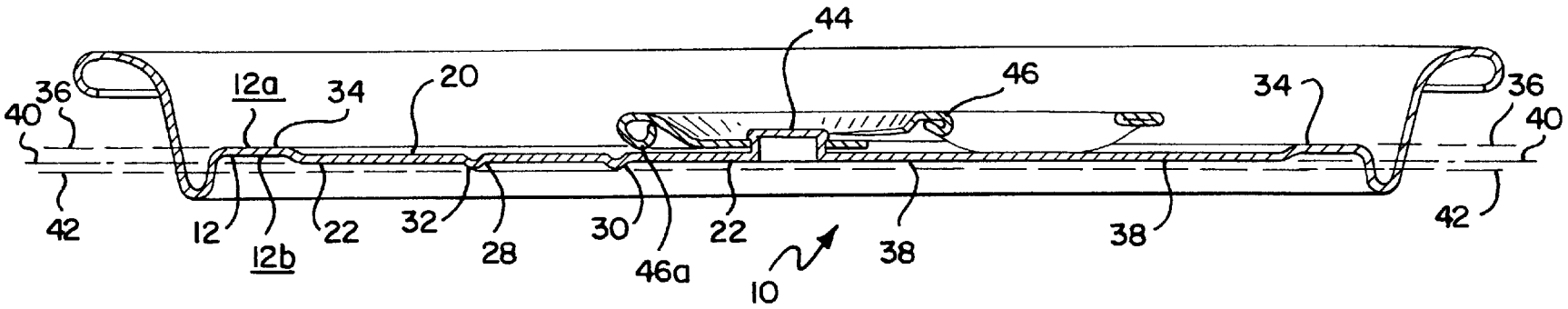
FIG. 3 is a cross-section view of the end of FIG. 1, along section lines 3—3 in FIG. 1.

In the preferred embodiment of FIGS. 1–3, the end closure 10 for a container (not shown) has a central panel wall 12 having a seaming curl 14 for joining the wall to the container. The container is typically a drawn and ironed metal can, usually constructed from a thin plate of aluminum or steel. End closures for such containers are also typically constructed from a cutedge of thin plate of aluminum or steel, formed into blank end, and manufactured into a finished end by a process often referred to as end conversion. In the embodiment shown in the Figures, the central panel is joined to a container by a seaming curl 14 which is joined to a mating curl of the container. The seaming curl 14 of the end closure 10 is integral with the central panel 12 by a countersink area 16 which is joined to the panel outer edge 18 of the central panel 12. This type of means for joining the central panel 12 to a container is presently the typical means for joining used in the industry, and the structure described above is formed in the process of forming the blank end from a cutedge of metal plate, prior to the end conversion process. However, other means for joining the central panel to a container may be employed with the present invention.

The steps of manufacturing the end begin with blanking the cutedge, typically a round or non-round cutedge of thin metal plate. The cutedge is then formed into a blank end by forming the seaming curl, countersink, panel radius and the central panel.

The conversion process for this type of end closure includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring or embossing (or debossing), and restriking the rivet island.

The central panel wall 12 has a displaceable opening panel 20 defined by a frangible score 22 and a non-frangible hinge segment 24. The opening panel 20 of the central panel 12 may be opened, that is the frangible score 22 may be severed and the tear panel 20 displaced at an angular orientation relative to the remaining portion of the central panel 12, while the tear panel 20 remains hingeably connected to the central panel 12 through the hinge segment 24. In this opening operation, the tear panel 20 is displaced at an angular deflection. More specifically, the tear panel 20 is deflected at an angle relative to the plane of the panel 12, with the vortex of the angular displacement being the hinge segment 24.

The opening panel 20 is formed during the conversion process by a scoring operation. The tools for scoring the tear panel 20 in the central panel 12 include an upper die on the public side 12*a* having a scoring knife edge in the shape of the tear panel 20, and a lower die on the product side 12*b* to support the metal in the regions being scored. When the upper and lower die (not shown) are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score is formed by the scoring knife edge causing movement of metal, such that the imprint of the scoring knife edge is made in the public side 12*a* of the panel wall 12. This movement of metal results in excess metal in the panel wall 12, causing a slack of loose excess metal, a condition known to persons in the art to be undesirable.

An inner deboss bead 26 is formed in the opening panel 20. The inner bead 26 is adapted to remove excess metal, or slack, in the opening panel 20 and to stiffen the opening panel 20. A very different type of bead on the opening panel of prior art devices is the common raised bead that extends upward from the public side of the end member, sometimes called an emboss bead. Unlike such common prior-art container ends, the inner bead 26 of the present invention is a deboss bead—that is, a bead that is depressed into the public side 12*a* of the panel wall 12 of the end closure 10, without any raised (emboss) bead being formed.

Another important feature of the inner deboss bead 26 of the opening panel 20 is that the inner deboss bead 26 is formed as a narrow channel extending downward of the product side 12b of the opening panel 20, with generally opposed descending walls, an inner wall 28 and an outer wall 30, separated by a narrow bead channel 32. The bead channel 32 is preferably formed as a U-shaped segment that joins the inner wall 28 and the outer wall 30.

Preferably, formation of the opening panel bead 26 does not include any thinning of the metal thickness of the opening panel 20. Rather, the bead 26 is adapted to be formed as a bend of the metal into the bead U-shape, rather than the metal being squeezed or coined. The opening panel bead 26 is preferably formed in a shape (when the end 10 is viewed in plan view) which generally follows the geometric shape of the score 22 of the tear panel 20, thereby being adapted to evenly draw slack metal from the tear panel 20 and provide uniform stiffness to the opening panel 20. Further, in the preferred embodiment of the present invention, the inner deboss bead 26 is formed entirely in the area of the opening panel 20 that is exposed from the nose 46*a* of the tab 46. In this arrangement, the nose 46*a* of the tab 46 resides over the opening panel to engage the opening panel 20, without direct contact between the tab nose 46*a* and the deboss bead 26. As shown in the Figures, the inner deboss bead is formed as a D-shape, or kidney-shape, to be located on the opening panel exposed from the tab nose 46*a*, while still generally following the shape of the score 22.

In the preferred embodiment, the tooling used to form the deboss bead 26 is placed in the same station as the tooling for score 22 formation. Because of the nature of forming a deboss bead 26 according to the present invention, the bead 26 may be formed simultaneous with the formation of the score 22, thereby taking up loose metal from the formation of the score 22. The tools (not shown) for forming the bead 26 include an upper tool having a bead projection to engage with the public side 12*a* of the end member, and a lower tool having a recess for at least partially receiving the bead projection of the upper tool.

This arrangement of the deboss bead 26 tooling differs significantly from the emboss bead tools of prior art ends, whereby the prior art ends are made by tooling having reversed arrangement from the above-described tooling. One significant disadvantage of the prior art emboss-bead tooling was that the prior art emboss bead cannot be formed simultaneous with the score formation. If the bead tools of the prior-art emboss bead were placed in the same manufacturing station as the score tools, the tooling arrangement would require the emboss bead to be at least partially formed prior to the score operation. Therefore, the prior-art emboss bead was at least partially formed prior to the score and the resulting slack metal in the opening panel. This limitation with the prior-art emboss bead reduces the benefit of the bead in removing such slack metal.

The tooling arrangement of the present invention, on the other hand, differs from the prior art tooling in that the projecting bead tool contacts the same side of the end as the score tools—that is, the public side 12*b*. This tooling arrangement of the method of making the deboss bead 26 permits the inner bead 26 to be simultaneously formed with the formation of the score 22, thereby efficiently drawing up the slack metal from score formation. Further, because of the improved drawing of slack metal by the deboss bead 26, the inner bead may have a lesser bead height (or bead depth) than that of the prior-art emboss bead.

According to an aspect of the invention, the end closure 10 has a panel wall 12 with an outer region 34 generally defined along a first horizontal plane 36. The panel wall 12 of the end closure 10 further has a deboss panel 38 positioned inward of the outer region 34, the deboss panel 38 being generally defined along a second horizontal plane 40 located below the first plane 36. In the preferred embodiment, the deboss panel 38 includes an area of the panel wall 12 that encompasses the rivet 44, the entire outer perimeter of the tab 46, and the entire opening panel 20. The inner bead 26 is a deboss bead that extends downward from the first and second horizontal plane 36, 40, In this manner, the inner bead 26 appears as a U-shaped bead in cross-section, extending below the second horizontal plane 40 such that the bead channel 32 resides in a third horizontal plane 42.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. An end closure for a container having a retained tab and an opening panel region, comprising:

a central panel wall having a product side and a public side and having a tab and a rivet;

a displaceable opening panel in the central panel wall at least substantially defined by a frangible score having a curvilinear shape and by a non-frangible hinge segment;

the tab being attached to the public side of the central panel wall by the rivet, at least a nose portion of the tab extending over a portion of the opening panel, a lift end of the tab being opposite the tab nose;

a deboss bead of substantially uniform width formed in the opening panel and comprising a narrow channel extending downward of the product side, the entire deboss bead being formed of a first wall generally opposed to a second wall, said first and second wall being separated by an arcuate intermediate segment defining the bottom of said narrow channel.

2. The end closure of claim 1, wherein the deboss bead of the opening panel is generally D-shaped.

3. The end closure of claim 1, wherein the deboss bead is a narrow U-shaped channel.

4. The end closure of claim 1, wherein the central panel wall has a deboss region surrounding the tab and the opening panel and residing along a second plane positioned below a first plane defined by the remaining outer portion of the panel wall, said deboss bead extending downward of said second plane.

5. The end closure of claim 1, wherein the deboss bead of the opening panel is curvilinear and has a shape with a first segment generally following a portion of curvilinear shape of the frangible score and a second segment generally following the outer geometry of the tab nose.

6. An end closure for a container having a retained tab and an opening panel region, comprising:

a central panel wall having a product side and a public side and having a tab and a rivet;

a displaceable opening panel in the central panel wall at least substantially defined by a frangible score having a curvilinear shape and by a non-frangible hinge segment;

the tab being attached to the public side of the central panel wall by the rivet, at least a nose portion of the tab extending over a portion of the opening panel, a lift end of the tab being opposite the tab nose;

a deboss bead formed in the opening panel and comprising a narrow channel extending downward of the product side, wherein the portion of the tab nose extending over the opening panel defines a first area of the opening panel positioned under said tab and the remaining area of the opening panel defining a second area, said deboss bead residing solely in the second area of the opening panel.

7. An ecology end closure for a container, comprising:

a central panel wall having a product side and a public side, the public side having a tab secured by a rivet;

an outer region of said central panel wall being generally defined along a first horizontal plane, a deboss panel of the panel wall inward of the outer region residing along a second horizontal plane positioned below said first plane;

the deboss panel having a displaceable opening panel at least substantially defined by a frangible score having a curvilinear shape and by a non-frangible hinge segment;

an inner deboss bead formed in the opening panel and consisting of a narrow channel extending downward from the second plane and being formed by an outer wall and a generally opposed inner wall, said outer and inner wall each having a substantially identical slope and being separated by an arcuate intermediate segment positioned below the second plane.

8. The end closure of claim 7, herein the inner bead is a narrow U-shaped channel residing below the second plane.

9. The end closure of claim 7, wherein the inner bead has a first segment positioned along the frangible score generally following at least a portion of curvilinear shape of the frangible score, and a second segment generally following an outer geometry of the tab nose.

10. The end closure of claim 9, wherein the inner bead has a curvilinear shape that is generally D-shaped.

11. The end closure of claim 9, wherein the first segment has a curvilinear shape and the second segment is generally parallel of said curvilinear shape.

12. A method of making a container end from thin plate metal formed into a blank and converted into an ecology end, comprising the steps of;

providing a blank end having a central panel with a public side and a product side;

forming a rivet in the center of the panel protruding from the public side;

scoring the metal with a score tool on the public side of the panel wall to create a frangible score of the metal defining an opening panel and simultaneously forming a deboss bead of substantially uniform width in said opening panel with a bead tool forced onto the public side of the panel wall, said forming of the deboss bead adapted to draw a slack metal of the opening panel resulting from said scoring of the metal; and, inserting a tab onto the rivet and staking said rivet to secure said tab to the public side of the panel wall.

13. The method of claim 12, wherein the step of forming a deboss bead includes forcing the metal with the bead tool to form a bead that is a narrow groove along its entire extent, which is generally U-shaped in cross-section.

14. The method of claim 12, further including the steps of forming a deboss panel by bending metal in a central area of the panel wall to reside along a plane below an outer portion of the panel wall.

15. The method of claim 14, wherein the step of forming the deboss bead includes forcing the metal with the bead tool such that the bead is a narrow U-shaped channel along its entire extent that extends below the plane of the deboss panel.

16. An end closure for a container having a retained tab and an opening panel region, comprising:

a central panel wall having a product side and a public side and having a tab and a rivet;

a displaceable opening panel in the central panel wall at least substantially defined by a frangible score having a curvilinear shape and by a non-frangible hinge segment;

the tab being attached to the public side of the central panel wall by the rivet, at least a nose portion of the tab extending over a portion of the opening panel, a lift end of the tab being opposite the tab nose;

a deboss bead formed in the opening panel and comprising a narrow channel extending downward of the product side;

the tab nose is adapted to contact an aligned area of the opening panel when lifting force is applied to said lift end, said deboss bead being located on the opening panel in other than said aligned area.

17. An ecology end closure for a container, comprising:

a central panel wall having a product side and a public side, the public side having a tab secured by a rivet;

an outer region of said central panel wall being generally defined along a first horizontal plane, a deboss panel of the panel wall inward of the outer region residing along a second horizontal plane positioned below said first plane;

the deboss panel having a displaceable opening panel at least substantially defined by a frangible score having a curvilinear shape and by a non-frangible hinge segment;

an inner deboss bead formed in the opening panel and comprising a narrow channel extending downward from the second plane;

the tab has a nose portion positioned above a covered area of the opening panel, said deboss bead being located on the opening panel in other than said covered area.

18. A method of making a container end from thin plate metal formed into a blank and converted into an ecology end, comprising the steps of;

providing a blank end having a central panel with a public side and a product side;

forming a rivet in the center of the panel protruding from the public side;

scoring the metal with a score tool on the public side of the panel wall to create a frangible score of the metal defining an opening panel and simultaneously forming a deboss bead in said opening panel with a bead tool forced onto the public side of the panel wall, said forming of the deboss bead adapted to draw a slack metal of the opening panel resulting from said scoring of the metal; and, inserting a tab onto the rivet and staking said rivet to secure said tab to the public side of the panel wall;

the step of forming a deboss bead includes forming the bead in a shape that resides in the opening panel other than in a covered area residing under a nose portion of the tab when the tab is secured to the public side.

* * * * *